US010799037B2

(12) United States Patent
Luo

(10) Patent No.: US 10,799,037 B2
(45) Date of Patent: Oct. 13, 2020

(54) CONTAINER FOR STORING, DISPLAYING, AND SERVING PRODUCE

(71) Applicant: Yan Luo, Pasadena, CA (US)

(72) Inventor: Yan Luo, Pasadena, CA (US)

( * ) Notice: Subject to any disclaimer, the term of this patent is extended or adjusted under 35 U.S.C. 154(b) by 0 days.

(21) Appl. No.: 16/279,272

(22) Filed: Feb. 19, 2019

(65) Prior Publication Data

US 2019/0174935 A1 Jun. 13, 2019

(51) Int. Cl.

| | |
|---|---|
| ***A47F 3/00*** | (2006.01) |
| ***A47F 3/06*** | (2006.01) |
| ***A47G 23/06*** | (2006.01) |
| ***A47F 3/14*** | (2006.01) |
| ***A47G 19/02*** | (2006.01) |
| ***A47F 7/00*** | (2006.01) |
| ***B65D 85/00*** | (2006.01) |
| ***A47B 75/00*** | (2006.01) |
| *B65D 85/34* | (2006.01) |

(52) U.S. Cl.

CPC ..... *A47F 3/001* (2013.01); *A47B 75/00* (2013.01); *A47F 3/06* (2013.01); *A47F 3/14* (2013.01); *A47F 7/0071* (2013.01); *A47G 19/025* (2013.01); *A47G 23/0633* (2013.01); *B65D 85/00* (2013.01); *A47G 2023/0658* (2013.01); *A47G 2023/0691* (2013.01); *B65D 85/345* (2013.01)

(58) Field of Classification Search

CPC .... A47F 3/001; A47F 3/06; A47F 3/14; A47F 3/004; A47F 3/0417; A47F 3/0486; A47F 5/0025; A47G 23/0633

See application file for complete search history.

(56) References Cited

U.S. PATENT DOCUMENTS

| | | | | | |
|---|---|---|---|---|---|
| 1,375,502 | A | * | 4/1921 | Giddings | A47F 3/001 34/88 |
| 1,499,957 | A | * | 7/1924 | Turner | A47F 3/001 34/88 |
| 1,735,603 | A | * | 11/1929 | Curtis | A47G 23/0633 135/96 |
| 1,754,518 | A | * | 4/1930 | Carl | A47F 3/001 312/114 |
| 3,756,681 | A | | 9/1973 | Coston | |

(Continued)

FOREIGN PATENT DOCUMENTS

| | | | |
|---|---|---|---|
| CN | 106287253 | A | 1/2017 |
| EP | 0356779 | A1 | 3/1990 |
| JP | 06237849 | A | 8/1994 |

OTHER PUBLICATIONS

VeggiDome product, posted at veggidome.com, retrieved on Sep. 17, 2019, <https://veggidome.com/>.

*Primary Examiner* — Anabel Ton

(74) *Attorney, Agent, or Firm* — Gloria Tsui-Yip, Esq.; Gottlieb, Rackman & Reisman, P.C.

(57) ABSTRACT

A container for storing, displaying, and serving fresh produce that extends the shelf life without refrigeration. The container includes a bottom tray, a slotted tray, a vertical extending wall, a cover, and a light source. The slotted tray sits above and nests within the bottom tray. The vertical wall removably extends from the bottom tray to form a compartment defined by the vertical wall and the bottom and slotted trays for fresh produce. The cover sits on the vertical wall enclosing the compartment. The light source shines light into the compartment.

18 Claims, 6 Drawing Sheets

(56) References Cited

U.S. PATENT DOCUMENTS 4,108,515 A * 8/1978 Johnson ..... A47F 3/06 211/151
4,673,087 A 6/1987 Webb
4,842,875 A 6/1989 Anderson
5,045,331 A 9/1991 Antoon, Jr.
D370,343 S 6/1996 Kraner
5,902,034 A * 5/1999 Santosuosso ..... A47F 3/001 362/125
5,931,333 A * 8/1999 Woodnorth ..... A47J 43/24 220/367.1
6,455,816 B1 * 9/2002 Reddy ..... A47F 3/001 126/337 R
7,055,690 B1 * 6/2006 Valdez ..... A47F 3/14 206/215
7,097,326 B1 * 8/2006 Pipolo ..... F21V 33/00 362/132
D664,859 S 8/2012 Puccioni
D686,920 S 7/2013 Cassius et al.
9,034,271 B2 5/2015 Shur et al.
9,198,306 B1 * 11/2015 Feinstein ..... G09B 19/0046
9,352,877 B2 5/2016 Furlong
D765,466 S 9/2016 Decker et al.
D795,652 S 8/2017 Burns
D796,267 S 9/2017 Burns
D803,626 S 11/2017 Burns
D816,434 S 5/2018 Burns
2003/0233841 A1 * 12/2003 Yingst ..... A47F 3/001 62/246
2004/0090771 A1 * 5/2004 Rowland, Jr. ..... A47F 3/001 362/125
2004/0131736 A1 * 7/2004 Pan ..... A23B 7/148 426/419
2006/0227537 A1 * 10/2006 Vanderschuit ..... F21V 33/0028 362/154
2006/0279947 A1 * 12/2006 Henley, Jr. ..... F25D 27/00 362/154
2007/0103895 A1 * 5/2007 Riesebosch ..... F25D 27/00 362/154
2007/0247831 A1 * 10/2007 Buelow, II ..... A47F 3/001 362/92
2008/0083722 A1 * 4/2008 Quella ..... A47F 3/001 219/214
2008/0094837 A1 * 4/2008 Dobbins ..... F21K 9/278 362/249.01
2008/0169735 A1 * 7/2008 Yamazaki ..... A47F 3/001 312/114
2014/0374082 A1 * 12/2014 Pena ..... F24F 3/1411 165/222
2015/0027919 A1 * 1/2015 Bourget ..... A47G 23/0633 206/459.5
2016/0010845 A1 * 1/2016 Brown ..... F21L 4/00 362/551
2019/0090659 A1 * 3/2019 Fixler ..... A47F 3/001

* cited by examiner

CONTAINER FOR STORING, DISPLAYING, AND SERVING PRODUCE

FIELD OF THE INVENTION

This invention relates to a container for storing, displaying, and serving food. In particular, a container for conveniently and attractively storing, displaying, and serving fresh produce.

BACKGROUND OF THE INVENTION

Most fresh produce has a relatively short shelf-life. The use of refrigeration can extend the shelf-life for certain fresh produce. Such fresh produce are often stored in a drawer compartment in the refrigerator. Once put in a drawer compartment, the fresh produce are not easily seen and are often forgotten until they are already past their shelf-life and no longer edible.

Therefore, there is a need for a container that conveniently and attractively stores, displays, and serves fresh produce while extending the shelf-life of the fresh produce.

SUMMARY OF THE INVENTION

The present invention is a container that conveniently and attractively stores, displays, and serves fresh produce. The container of the present invention extends the shelf-life of fresh fruits and vegetables without the need for refrigeration.

The container of the present invention includes a bottom tray, a slotted tray, a vertical extending wall, a cover, and a light source. The slotted tray sits above and nests within the bottom tray. The vertical wall removably extends from the bottom tray to form a compartment defined by the vertical wall and the bottom and slotted trays. The cover sits on the vertical wall enclosing the compartment. The light source shines light into the compartment.

Fresh produce is placed within the compartment on top of the slotted tray, which allows the produce to breathe and any excess moisture from the produce to be collected below the slotted tray on the bottom tray such that the moisture does not come into direct contact with the produce. A user can access the fresh produce by lifting the cover or the vertical wall along with the cover.

The container of the present invention is made of a transparent or translucent material such that the fresh produce stored therein is attractively and visually displayed to encourage a user to see and eat the fresh produce.

BRIEF DESCRIPTION OF THE DRAWINGS

Preferred embodiments of the present invention have been chosen for purposes of illustration and description and are shown in the accompanying drawings forming a part of the specification wherein.

DETAILED DESCRIPTION OF THE PREFERRED EMBODIMENTS

Figure 1:
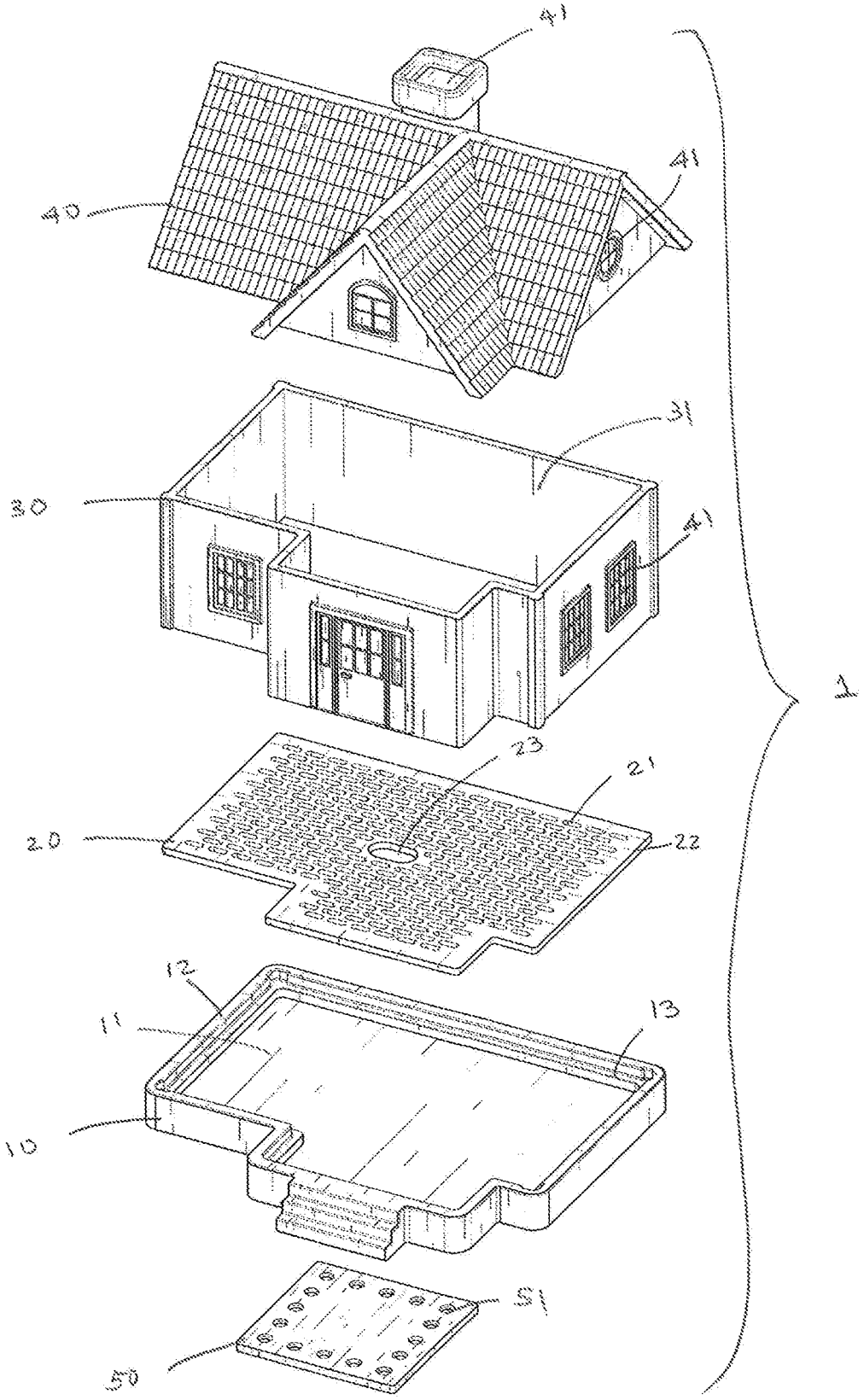
FIG. 1 is an exploded view of the container of the present invention.
Figure 2:
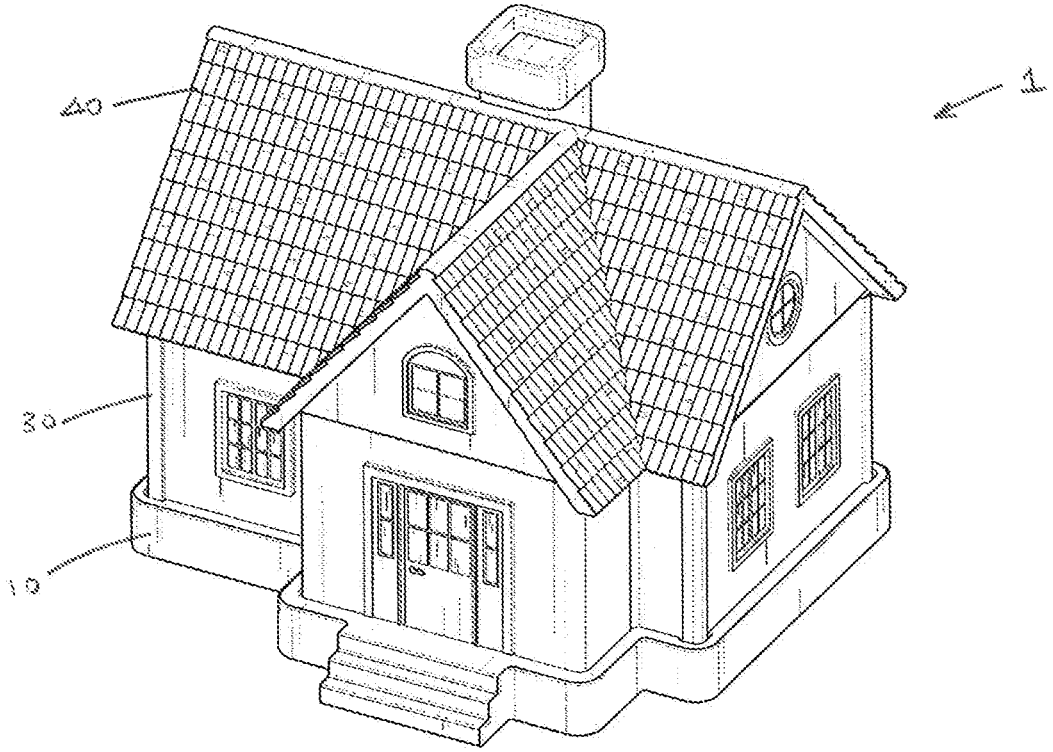
FIG. 2 is a perspective view of the container.
Figure 3:
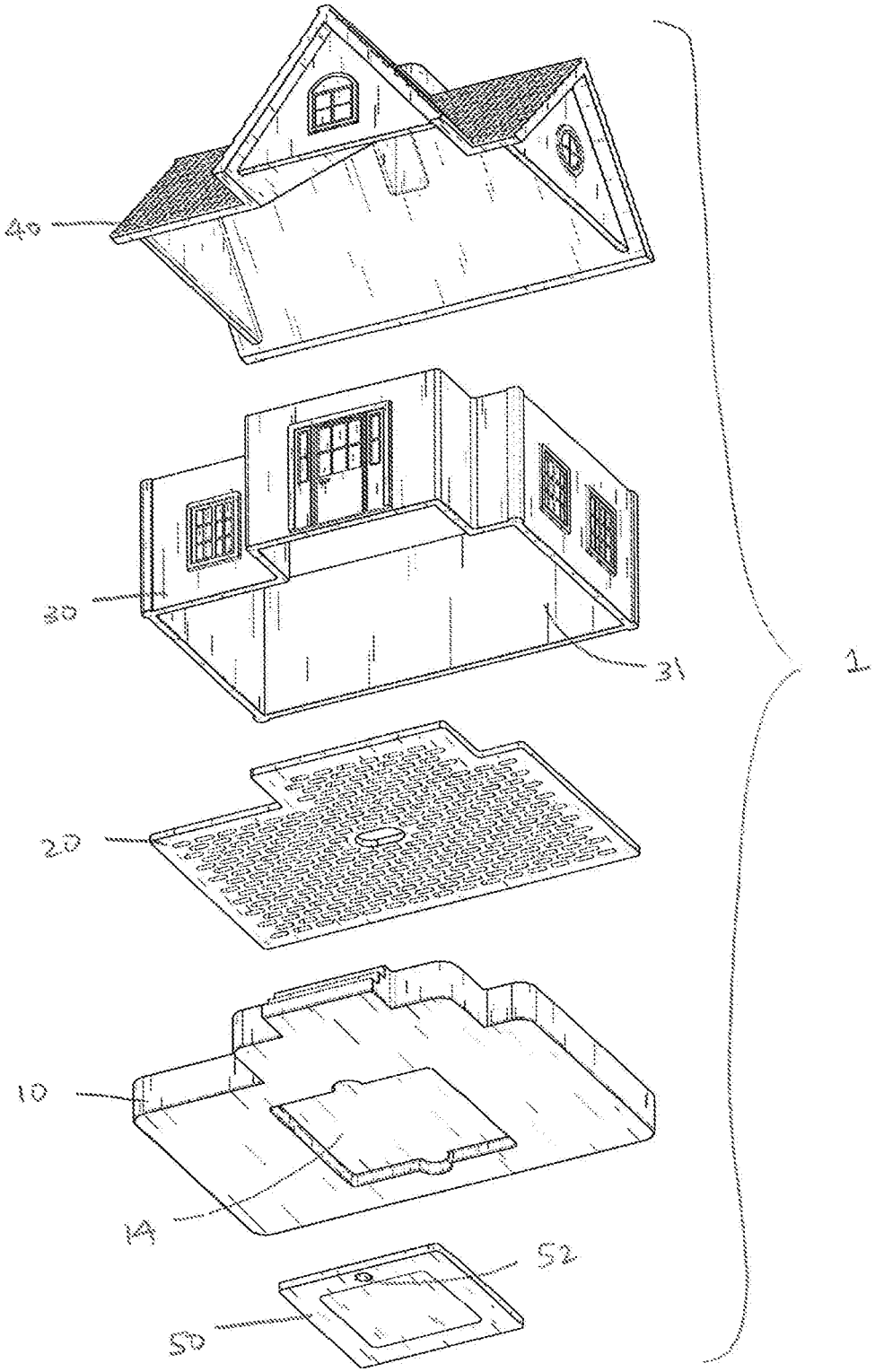
FIG. 3 is another exploded view of the container.
Figure 4:
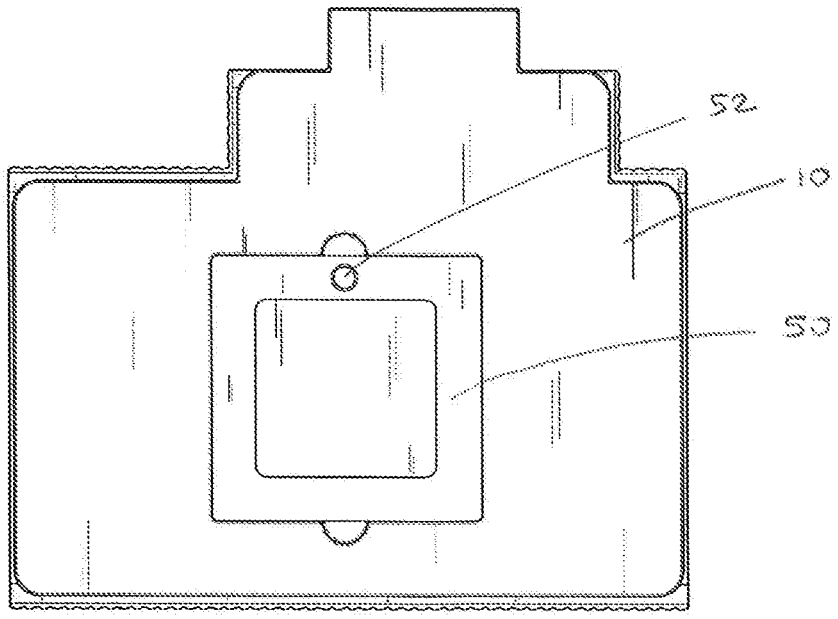
FIG. 4 is a bottom plan view of the container.

With reference to the drawings, wherein the same reference number indicates the same element throughout, there is shown in FIG. 1 a container 1. The container 1 of the present invention includes a bottom tray 10, a slotted tray 20, a vertical extending wall 30, a cover 40, and a light source 50.

As shown in FIGS. 1-4, the container 1 has an appearance of a house with a gable roof, a chimney, a door, a plurality of windows, and front steps. The bottom tray 10 has a planar bottom element 11 with vertically extending edge 12 around the circumference of the entire planar bottom element 11. The outer surface of the edge 12 has the appearance of the foundation wall of the house with front steps. The inner surface of the edge 12 has a circumferential ledge 13. The shape and size of the bottom tray 10 can vary. The height of the edge 12 can vary. The height of the ledge 13 with respect to the height of the edge 12 can also vary.

The slotted tray 20 is generally planar with a plurality of holes or slots 21. The holes or slots 21 can vary in number, size, shape and distance between each other, so long as fresh produce placed on the slotted tray 20 would not fall through such holes or slots 21. At least one of the plurality of holes or slots 23 is sized to allow a user to partially insert his/her fingertip to lift the slotted tray 20. The holes or slots 21 can be on the border 22 of the slotted tray 20 such that they form notches at the border 22 (not shown). The holes or slots 21 allow moisture or liquid to be drawn away from fresh produce that sits on the slotted tray 20. The slotted tray 20 is sized and shaped to nest within and at least partially rests on the circumferential ledge 13 of the bottom tray 10 such that the slotted tray 20 is spaced apart from the planar bottom element 11. However, the slotted tray 20 can also sit directly on the planar bottom element 11.

The vertically extending wall 30 is sized and shaped to sit adjacent the inner surface of edge 12 and above the slotted tray 20 to form a compartment 31 defined by the vertically extending wall 30 and the bottom and slotted trays 10 and 20. The vertically extending wall 30 can be perpendicular to the bottom tray 20, but it can also be an angle. The vertically extending wall 30 can extend around the entire edge 12 of the bottom tray 10. The outer surface of the vertically extending wall 30 has the appearance of a door and a plurality of windows. The vertically extending wall 30 may have internal wall (not shown) acting as a divider to form multiple compartments 31.

The cover 40 sits on the vertically extending wall 30 to enclose the compartment 31. The cover 30 is sized and shaped to completely enclose the compartment 31. The cover 40 can be sized and shaped to be the same or slightly larger than as the vertically extending wall 30. The cover 40 has the appearance of a gable roof with a chimney, and a plurality of windows.

The vertically extending wall 30 and cover 40 may have one or more small openings 41 to allow ventilation or encourage air circulation from the compartment 31 to the atmosphere, if desirable. Such openings 41 can be anywhere on the vertically extending wall 30 or cover 40, or it can be at the chimney, window or door. Such openings 41 can also be closeable such as by a sliding panel or a pivoting panel (as in a real window, a real door, or a real damper of a chimney).

The light source 50 is generally planar and fits removably flushed into a correspondingly sized cavity 13 on the underside of bottom tray 10. The cavity 13 can be sized to frictionally fit the light source 50 with a cutout for a fingertip to reach and remove the light source 50. The light source 50 can also be removably fit into the cavity 13 by magnet, hooks and loops, latch, or other removably fastening means known to one skilled in the art. The light source 50 provides illumination into the compartment 31. The light source 50 can include a plurality of light emitting diodes (LEDs) 51. The light source 50 can be battery operated, with built-in rechargeable battery, solar powered, AC/DC powered or otherwise powered as known to one skilled in the art. A button switch 52 can be provided to turn the light source 50 on/off. The light source 50 can also be turned on/off with other constructions or methods known to one skilled in the art, such as a proximity sensor, a pressure sensor, a slide switch, a rotating switch, a remote control, etc. The light source 50 can have variable settings with different brightness and/or flashing frequency.

The entire container 1 is made of a transparent or translucent material. Elements of the container 1 can be made of a clear food-safe acrylic or plastic material, such that it is not breakable. Elements of the container 1 can also be made of glass.

When container 1 is placed in a user's kitchen, counter, or dining room, its unique design is attractive and inviting to a user to look at and eat the fresh produce from therein. The house design of container 1 may be a replicate of the user's own house to make it more interesting. To use the container 1, a user lifts the cover 40 to access the compartment 31. A user can easily grab the chimney of the cover 40 to remove the cover 40. A user can place washed and cleaned fresh produce into the compartment 31 before closing the cover 40. Moisture from the fresh produce drips through the holes or slots 21 of the slotted tray 20 and is collected in the bottom tray 10. Similarly, any condensation inside the compartment 31 travels from the cover 40 to the vertically extending wall 30, through the holes or slots 21 to be collected in the bottom tray 10. For certain fresh produce where additional moisture is desirable, water can be added to the bottom tray 10. With the vertically extending wall 30 that is generally perpendicular, it provides wide open access to the compartment 31 to facilitate placing into and accessing fresh produce from the compartment 31. With the illumination from the light source 50, the fresh produce placed into the compartment 31 is showcased and attracts attention and encourages the user to reach for and eat the fresh produce. The light source 50 can also be used as a night light, especially when controlled by a proximity sensor. This also encourages late night snacking of fresh produce. The different elements of the container 1 are easily separated to allow thorough cleaning and washing, when necessary, of all the elements with the light source 50 removed. The different elements of the container 1 are also easily assembled back together.

Figure 5:
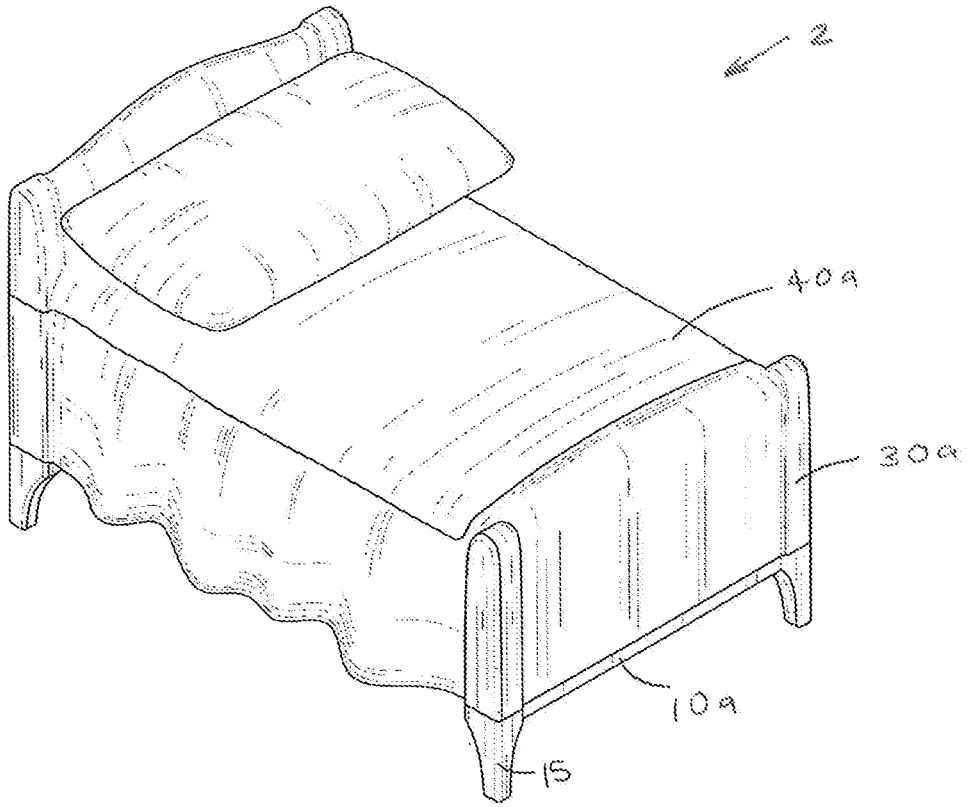
FIG. 5 is a perspective view of another embodiment of the container of the present invention.
Figure 6:
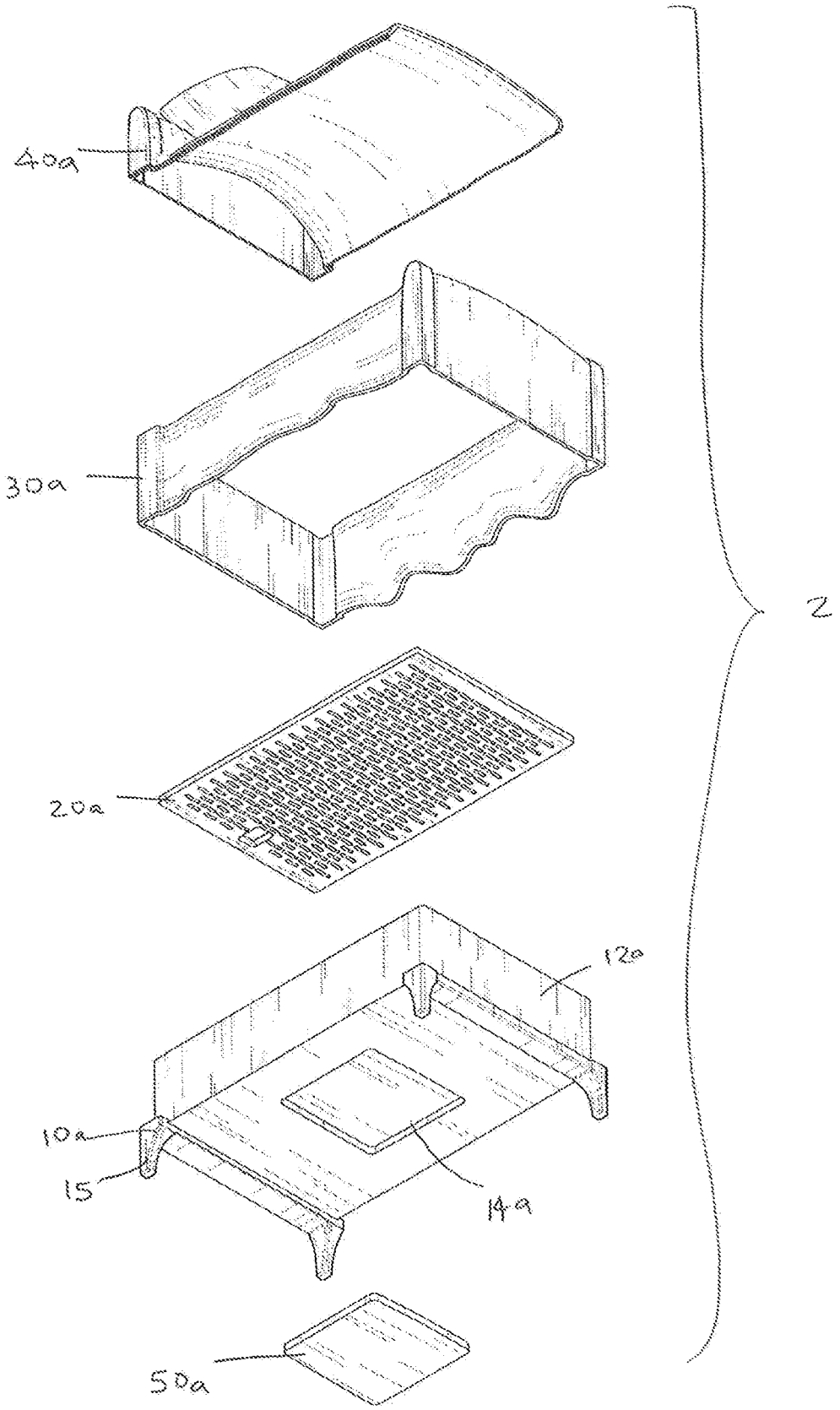
FIG. 6 is an exploded view of the container of FIG. 5.

FIGS. 5-6 shows a second embodiment of the container 2 of the present invention having an appearance of a bed with a pillow, bed covering, bed skirt, and bed frame with legs, but otherwise has the same structure and elements as container 1. Container 2 includes a bottom tray 10*a*, a slotted tray 20*a*, a vertical extending wall 30*a*, a cover 40*a*, and a light source 50*a*.

The bottom tray 10*a* has the appearance of the bed frame with legs with a vertically extending edge 12*a*. The slotted tray 20*a* nests within and at least partially rests on a circumferential ledge 13*a* (not shown) of the bottom tray 10*a*. In comparison with the vertically extending wall 30 of container 1 that sits adjacent the inner surface of edge 12, a vertically extending wall 30*a* has the appearance of a bed skirt and sits adjacent the outer surface of edge 12*a* and rests on the bed legs 15. The cover 40*a* has the appearance of a bed covering and a pillow. A user can grab the pillow to easily remove the cover 40*a*. The light source 50*a* fits in a cavity 14*a* on the underside of bottom tray 10*a*.

The container of the present invention can take on other attractive shapes and forms, such as a shoe, a car, a computer, a planter, etc.

The features of the invention illustrated and described herein are the preferred embodiments. Therefore, it is understood that the specification is intended to cover unforeseeable embodiments with insubstantial differences that are within the spirit of the specification.

What I claim is:

1. A container for storing, displaying, and serving fresh produce comprising:

a bottom tray having a planar bottom element with a vertically extending edge around a circumference of said planar bottom element, said vertically extending edge having a top edge;

a slotted, planar, tray having a plurality of holes that nests within said vertically extending edge and below said top edge of said vertically extending edge, and sits above said bottom tray;

a vertically extending wall that extends generally perpendicular to said bottom tray and sits adjacent and within said vertically extending edge defining a compartment for the fresh produce;

a cover enclosing said compartment; and a light source removably attachable to said bottom tray to illuminate said compartment.

2. The container of claim 1 wherein said bottom tray, said slotted tray, said vertically extending wall, and said cover are made of a transparent material.

3. The container of claim 1 wherein said bottom tray, said slotted tray, said vertically extending wall, and said cover are made of a translucent material.

4. The container of claim 1 wherein said bottom tray, said slotted tray, said vertically extending wall, and said cover are made of a food safe acrylic material.

5. The container of claim 1 wherein said bottom tray further having a circumferential ledge on an inner surface of said vertically extending edge, and said slotted tray at least partially sits on said circumferential edge such that it is spaced apart from said planar bottom element.

6. The container of claim 1 wherein at least one of said plurality of holes is sized to allow a user to partially insert his/her fingertip to lift said slotted tray.

7. The container of claim 1 wherein said cover has at least one opening into said compartment.

8. The container of claim 7 wherein said at least one opening is selectively closeable.

9. The container of claim 1 wherein an underside of said bottom tray has a cavity for receiving said light source.

10. The container of claim 1 wherein said light source includes a plurality of light emitting diodes.

11. The container of claim 1 wherein said light source is battery operated.

12. The container of claim 1 wherein said light source is solar powered.

13. The container of claim 1 wherein said light source includes an on/off button.

14. The container of claim 1 wherein said light source includes a proximity sensor that controls on/off.

15. The container of claim 1 wherein said light source is remotely controlled.

16. The container of claim 1 wherein said light source has variable settings with different brightness.

17. The container of claim 1 wherein said light source has variable settings with different flashing frequency.

18. A method of storing, displaying, and serving fresh produce, comprising the steps of:

providing a bottom tray with a planar bottom element and a vertically extending edge around a circumference of said planar bottom element;

providing a slotted tray having a plurality of holes that nests within said vertically extending edge and sits above said bottom tray;

providing a vertically extending wall that extends generally perpendicular to said bottom tray and sits adjacent said vertically extending edge defining a compartment;

placing fresh produce in said compartment;

providing a cover enclosing said compartment; and providing a light source removably attached to said bottom tray to illuminate the fresh produce in said compartment.

* * * * *